US010344745B2

(12) United States Patent
Hallundbæk et al.

(10) Patent No.: US 10,344,745 B2
(45) Date of Patent: Jul. 9, 2019

(54) DOWNHOLE HYDRAULIC PUMP

(75) Inventors: Jørgen Hallundbæk, Græsted (DK); Peter Gråbæk, Greve (DK)

(73) Assignee: Welltec A/S, Allerød (DK)

( * ) Notice: Subject to any disclaimer, the term of this patent is extended or adjusted under 35 U.S.C. 154(b) by 401 days.

(21) Appl. No.: 14/130,944

(22) PCT Filed: Jul. 4, 2012

(86) PCT No.: PCT/EP2012/062980
§ 371 (c)(1),
(2), (4) Date: Jan. 6, 2014

(87) PCT Pub. No.: WO2013/007566
PCT Pub. Date: Jan. 17, 2013

(65) Prior Publication Data

US 2014/0127046 A1 May 8, 2014

(30) Foreign Application Priority Data

Jul. 8, 2011 (EP) ..... 11173224

(51) Int. Cl.
*F04B 1/047* (2006.01)
*E21B 43/12* (2006.01)
(Continued)

(52) U.S. Cl.
CPC ..... *F04B 1/0472* (2013.01); *E21B 43/128* (2013.01); *E21B 43/129* (2013.01); *F04B 47/00* (2013.01); *F04B 47/06* (2013.01)

(58) Field of Classification Search
CPC ..... F04B 1/0472; F04B 1/113; F04B 47/00; F04B 47/06; F04B 1/00; F04B 1/1071;
(Continued)

(56) References Cited

U.S. PATENT DOCUMENTS 2,025,277 A * 12/1935 Erwin ..... F04B 1/0538
417/486
2,431,492 A * 11/1947 Lewis ..... F04B 1/124
417/271
(Continued)

FOREIGN PATENT DOCUMENTS

CN 85101715 A 4/1987
CN 1070247 A 3/1993
(Continued)

OTHER PUBLICATIONS

Translation of FR 1,530,605; Deboute; May 1967.*
(Continued)

*Primary Examiner* — Essama Omgba
*Assistant Examiner* — Stephen A Mick
(74) *Attorney, Agent, or Firm* — Nixon & Vanderhye P.C.

(57) ABSTRACT

The present invention relates to a downhole hydraulic pump for providing fluid pressure during downhole operations, comprising a pump housing, a cam shaft rotatably arranged in the pump housing and having a longitudinal spin axis, the cam shaft comprising a shaft and a cam lobe arranged on the shaft, a radially arranged piston having a housing end and a cam end, a piston housing arranged in the pump housing, an inlet valve arranged in an inlet in the piston housing, an outlet valve arranged in an outlet in the piston housing, and a piston spring arranged in the pump housing for moving the piston away from the piston housing, wherein the piston housing is rotatably connected to the pump housing enabling rotation of the piston housing around a piston housing rotation axis parallel to the longitudinal spin axis of the cam shaft.

24 Claims, 8 Drawing Sheets

(51) Int. Cl.
*F04B 47/06* (2006.01)
*F04B 47/00* (2006.01)

(58) Field of Classification Search
CPC .... F04B 1/1075; F04B 1/1077; F04B 1/1078; F04B 27/06; F04B 27/0612; F04B 27/0619; F04B 27/0631; F04B 27/0638; F04B 27/0644; E21B 43/128; E21B 43/129
USPC ..... 417/273
See application file for complete search history.

(56) References Cited

U.S. PATENT DOCUMENTS 2,489,505 A * 11/1949 Schmidt ..... F03C 1/0536 417/339
3,486,454 A * 12/1969 Tuzson ..... F04B 1/146 417/271
3,922,957 A * 12/1975 Ogle ..... F04B 9/045 92/137
3,945,766 A * 3/1976 Gelon ..... F04B 1/113 417/273
4,270,439 A * 6/1981 Ponchaux ..... F03C 1/0419 417/273
4,536,137 A * 8/1985 Bookout ..... F04B 47/08 417/390
4,963,075 A * 10/1990 Albertson ..... F04B 43/026 417/221
5,183,075 A * 2/1993 Stein ..... F02M 59/462 137/493.6
5,251,664 A * 10/1993 Arvidsson ..... F16K 15/026 137/469
5,778,759 A * 7/1998 Johnson ..... F16J 1/12 92/129
5,876,186 A * 3/1999 Stiefel ..... F02M 59/04 417/273
5,967,018 A * 10/1999 Breveglieri ..... F03C 1/0605 417/269
5,975,864 A * 11/1999 De Santis ..... F04B 1/0413 417/273
5,979,297 A * 11/1999 Ricco ..... F02M 63/0001 417/273
6,220,144 B1 * 4/2001 Manring ..... F01B 3/0044 92/57
7,780,144 B2 * 8/2010 Van Der Linden ..... F02M 59/462 137/539
2005/0047929 A1 * 3/2005 Hanyu ..... F02M 37/043 417/273
2006/0013701 A1 * 1/2006 Boos ..... F02M 59/06 417/273
2006/0222512 A1 10/2006 Hansen
2007/0022984 A1 * 2/2007 Nagel ..... F01L 1/026 123/90.6
2007/0157801 A1 * 7/2007 Hanes ..... F04B 35/045 92/127
2008/0060513 A1 * 3/2008 Miller ..... F04B 1/0408 92/172
2008/0298991 A1 * 12/2008 Trubnikov ..... F04B 1/0421 417/521
2009/0068026 A1 * 3/2009 Henry ..... F04B 47/06 417/60
2009/0092510 A1 * 4/2009 Williams ..... F04B 1/00 417/521
2009/0308065 A1 * 12/2009 Rea ..... B60K 6/20 60/413
2010/0186695 A1 * 7/2010 Nakamura ..... F01L 13/0063 123/90.16
2010/0310395 A1 * 12/2010 Schmautz ..... B60T 8/4031 417/451
2011/0048369 A1 * 3/2011 Samuels ..... F01C 1/44 123/244

FOREIGN PATENT DOCUMENTS

CN 101048594 A 10/2007
CN 101285456 A 10/2008
CN 201568292 U 9/2010
CN 201802572 U 4/2011
DE 3726857 * 1/1989 ..... F04B 1/04
FR 1530605 * 5/1967
FR 2 296 778 7/1976
RU 2 224 908 C1 2/2004
RU 2 382 903 C1 2/2010

OTHER PUBLICATIONS

Translation of FR 2,296,778; Courtois; Jan. 1975.*
Translation of DE 3,726,957; Dusterloh; Mar. 1989.*
International Preliminary Report on Patentability and Written Opinion for corresponding PCT Application No. PCT/EP2012/062980, dated Jan. 14, 2014, 6 pages.
International Search Report for PCT/EP2012/062980, dated Aug. 21, 2012.
Written Opinion of the ISA for PCT/EP2012/062980, dated Aug. 21, 2012.

* cited by examiner

DOWNHOLE HYDRAULIC PUMP

This application is the U.S. national phase of International Application No. PCT/EP2012/062980 filed 4 Jul. 2012 which designated the U.S. and claims priority to EP Patent Application No. 11173224.4 filed 8 Jul. 2011, the entire contents of each of which are hereby incorporated by reference.

FIELD OF THE INVENTION

The present invention relates to a downhole hydraulic pump for providing fluid pressure during downhole operations.

BACKGROUND ART

Downhole tools using fluid as a driving force are increasingly used during downhole operations, especially for driving operational tools and/or for engagement of the borehole wall or borehole casing. Hydraulic power for these fluid working units is provided by downhole hydraulic pumps. Due to downhole conditions, such hydraulic pumps are limited in many ways and still have to perform efficiently to save time and money during downhole operations. The physical extent of the pumps is limited due to spatial restrictions in the borehole, the power supplied is limited, typically because a wireline reaching from the surface is limited due to large voltage drops over long distances, or if downhole batteries are used, the spatial restriction again becomes the limiting factor. Furthermore, hydraulic pumps must be efficient to provide sufficient driving force and speed for the downhole fluid working units since this limits downhole operating times, which in turn reduces cost. Also, downhole pumps must be durable since breakdowns are even more critical to operating times as all maintenance and repair must be done on the surface, necessitating a complete retraction of the downhole tools from the boreholes. Known hydraulic pumps comprise a plurality of piston chambers of cyclically varying volume in which the displacement of fluid through the piston chambers is provided by a rotating cam lobe forcing the pistons to move in a cyclic manner. However, such hydraulic pumps are often not sufficiently efficient to provide the power needed downhole and may furthermore suffer from wear on the moving parts.

SUMMARY OF THE INVENTION

It is an object of the present invention to wholly or partly overcome the above disadvantages and drawbacks of the prior art. More specifically, it is an object to provide an improved hydraulic pump providing more fluid power during downhole operations than prior art pumps.

The above objects, together with numerous other objects, advantages, and features, which will become evident from the below description, are accomplished by a solution in accordance with the present invention by a downhole hydraulic pump for providing fluid pressure during downhole operations, comprising:

- a pump housing,
- a cam shaft rotatably arranged in the pump housing and having a longitudinal spin axis, the cam shaft comprising a shaft and a cam lobe arranged on the shaft,
- a radially arranged piston having a housing end and a cam end,
- a piston housing arranged in the pump housing,
- an inlet valve arranged in an inlet in the piston housing,

- an outlet valve arranged in an outlet in the piston housing, and
- a piston spring arranged in the pump housing for moving the piston away from the piston housing, wherein the piston housing is rotatably connected to the pump housing, enabling rotation of the piston housing around a piston housing rotation axis parallel to the longitudinal spin axis of the cam shaft.

The downhole hydraulic pump according to the present invention may further comprise a plurality of pistons, piston housings, inlet and outlet valves and piston springs.

Further, the piston may be moved in a first direction in the piston housing by the cam lobe and in a second direction by the piston spring.

Moreover, the pump housing may have an inlet in fluid communication with the inlet of the piston housing.

Said pump housing may have an outlet in fluid communication with the outlet of the piston housing.

In an embodiment, a clearance distance between a piston side wall and an inner wall of the piston housing may be below ten micrometers in width.

The downhole hydraulic pump as described above may furthermore comprise a bearing arranged between the cam shaft and the cam ends of the plurality of pistons.

This bearing may be a needle bearing.

In addition, the downhole hydraulic pump according to the present invention may comprise a set of pistons, piston housings, inlet valves, outlet valves and piston springs arranged in the pump housing and having a mutual distance along the longitudinal axis.

Furthermore, the downhole hydraulic pump according to the present invention may comprise a plurality of pistons, a plurality of piston housings, a plurality of inlet valves, a plurality of outlet valves and a plurality of piston springs, and a set may comprise one piston, one piston housing, one inlet valve, one outlet valve and one piston spring. The downhole hydraulic pump may further comprise a plurality of sets arranged in the pump housing and having a mutual distance along the longitudinal axis, each set being arranged symmetrically in an asterisk shape, substantially radially away from the longitudinal spin axis.

In one embodiment, the pump may further comprise twelve pistons arranged in four layers of three pistons, each at four different positions along the longitudinal spin axis, each layer of three pistons being arranged radially with an asterisk angle of 120 degrees between them, and each layer being shifted in a shift angle of 30 degrees so that all twelve pistons have a unique radial position with a 30 degree separation to the radially neighbouring pistons.

Additionally, the inlet and outlet valves may be one-way valves, such as ball valves.

Moreover, a plurality of balls of the ball valves may be made from a ceramic material.

The downhole hydraulic pump according to the present invention may further comprise an accumulating unit in fluid connection with the plurality of outlet valves.

Further, the cam lobe having two cam lobe end faces may further comprise at least one hollow section providing a fluid communication channel between said cam lobe end faces.

The pump housing as described above having two pump housing end faces may further comprise at least one hollow section providing a fluid communication channel between said pump housing end faces.

In addition, the downhole hydraulic pump according to the present invention may further comprise a filter unit arranged upstream of, and in fluid connection with, the plurality of inlet valves.

Also, the downhole hydraulic pump according to present invention may further comprise a plurality of indentations in the pump housing, the indentations having a form corresponding to a neighbouring movable part comprised within the pump housing, such as the piston, the piston housing and/or the piston spring.

Additionally, the piston housing as described above may be rotatably suspended in the pump housing.

A maximum internal hydraulic pressure of the pump may preferably exceed 100 bars, more preferably exceed 300 bars, and even more preferably exceed 600 bars.

Moreover, the piston housings may be rotatably attached to the pump housing in a first end of the piston housing by arranging the inlet valve in a cylindrical groove in the pump housing, suspended by a rotatable ring-shaped seal in one end, and attaching an opposite end of the inlet valve in the piston housing and mutadis mutandis in a second end of the piston housing by arranging the outlet valve in a cylindrical groove in the pump housing and suspended by a rotatable ring-shaped seal in one end and attaching an opposite end of the outlet valve in the piston housing.

Further, the cam shaft may be suspended in the pump housing by a set of cam shaft bearings.

The piston spring as described above may be arranged circumscribing the piston.

Also, the piston spring may be arranged circumscribing the piston and partially circumscribing the piston housing.

The spring may be arranged inside the piston housing.

In addition, the piston may be hollow.

A maximum rotational speed of the pump may preferably exceed 4000 rpm, more preferably exceed 6000 rpm, and even more preferably exceed 8000 rpm.

Furthermore, the piston spring as described above may have a spring constant preferably exceeding 2000 N/m, more preferably exceeding 3000 N/m, and even more preferably exceeding 4000 N/m.

Finally, the downhole hydraulic pump according to the present invention may further comprise a plurality of grooves along an outer surface of the pump housing.

In an embodiment of the invention, the inlet and outlet valves may be fixedly connected with the pump housing or the piston housings.

Moreover, the inlet and outlet valves may be non-fixedly connected with the pump housing or the piston housings.

In addition, the inlet and outlet valves may be fixedly connected with the pump housing, and the inlet and outlet valves may be non-fixedly connected with the piston housings.

Furthermore, the inlet and outlet valves may be fixedly connected with the pump housing or the piston housings by a fixed ring-shaped valve seal.

Additionally, the inlet and outlet valves may be non-fixedly connected with the pump housing or the piston housings by non-fixed ring-shaped valve seal.

Finally, the inlet and/or outlet valves may be integral parts of the pump housing or the piston housings.

BRIEF DESCRIPTION OF THE DRAWINGS

The invention and its many advantages will be described in more detail below with reference to the accompanying schematic drawings, which for the purpose of illustration show some non-limiting embodiments and in which.

All the figures are highly schematic and not necessarily to scale, and they show only those parts which are necessary in order to elucidate the invention, other parts being omitted or merely suggested.

DETAILED DESCRIPTION OF THE INVENTION

Figure 1:
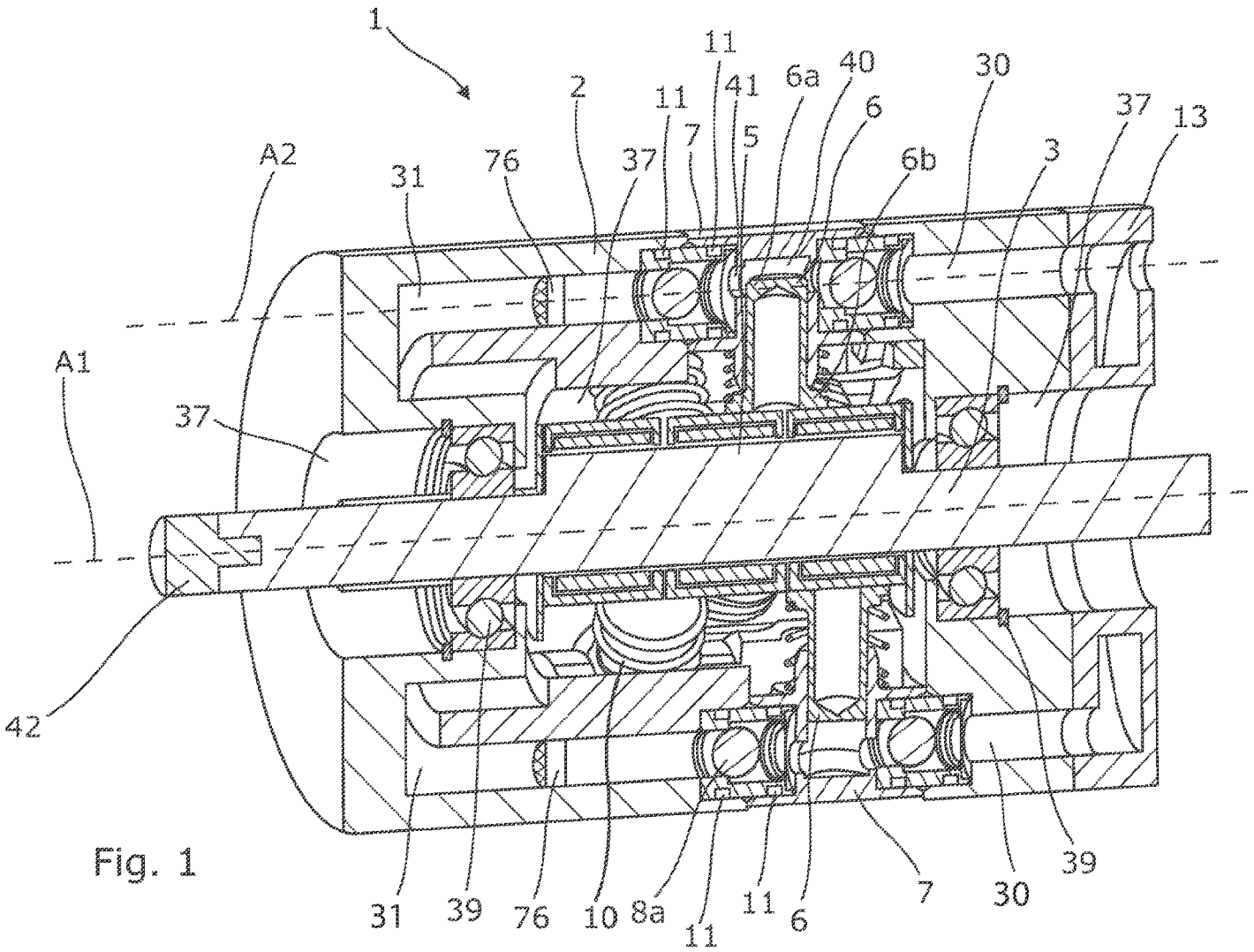
FIG. 1 shows a cross-sectional view of a downhole hydraulic pump.

FIG. 1 shows a cross-sectional view of a downhole hydraulic pump for providing fluid power during downhole operations. The hydraulic pump comprises a pump housing 2 and a cam shaft 3 rotatably arranged in the pump housing 2 and having a longitudinal spin axis A1. The cam shaft comprises a shaft 4 and a cam lobe 5 arranged on the shaft for moving a radially arranged piston 6 having a housing end 6*a* and a cam end 6*b* in a piston housing 7 arranged in the pump housing. A piston spring 10 is arranged in the pump housing between the piston housing 7 and the piston, forcing the piston to move in a direction towards the cam lobe. In this way, the cam lobe forces the piston in the direction of the piston housing, and the spring serves to move the piston in the opposite direction.

The term "fluid power" will be used throughout the text to define power transmitted by a controlled circulation of pressurised fluid to a motor or another unit that converts the fluid power into a mechanical output capable of doing work on a load. Fluid power is therefore a function of pressure as well as velocity of the hydraulic fluid.

The piston housing 7 has an inlet valve 8 arranged in an inlet of the piston housing 7 and an outlet valve 9 arranged in an outlet of the piston housing. The piston arranged in the piston housing encloses a volume. The valves are one-way valves, and when the cam lobe 5 moves the piston 6 into the piston housing 7, the volume is decreased and fluid in the volume is forced out through the outlet valve 9 into outlet channels 30. Further, when the cam moves away from the piston housing 7, the spring ensures that the piston 6 follows the cam shaft 3 in the opposite direction and that the volume increases, thereby letting fluid in through the inlet valve 8. In this way, a rotational force of the cam shaft is transferred to pumping fluid into outlet channels 30 to activate an operational tool connected to the pump.

The piston housing is rotatably connected to the pump housing, enabling rotation of the piston housing 7 around a piston housing rotation axis A2 parallel to the longitudinal spin axis A1 of the shaft 4. The hydraulic pump 1 may further comprise an accumulating unit 13 in fluid connection with the plurality of outlet valves 9 for collecting the pressurised fluid generated in all the piston housings 7. The hydraulic pump 1 may further comprise a filter 76 arranged upstream of, and in fluid connection with, the plurality of inlet valves 8 for filtering any unwanted coarse particles from the hydraulic fluid entering the piston housing 7. A filter 76 significantly reduces wear of the hydraulic pump 1.

The piston housings are arranged rotatably connected to the pump housing, as shown in FIG. 1, by means of the inlet and outlet valves 8, 9 acting as hinges or fixtures between the pump housing 2 and the piston housings 7. The movable attachment of the inlet and outlet valves 8, 9 to the piston housing is facilitated by a ring-shaped valve seal 11, such as provided by an O-ring, which in addition seals an interior of the inlet and outlet valves from an exterior. Since the interior of the inlet valve is fluidly connected to an inlet channel 31 of the pump housing 2, the valve seals 11 ensure that a hydraulic fluid circulating in the inlet channel of the hydraulic pump 1 enters the interior of the piston housing 7.

By using inlet and outlet valves 8, 9 and connecting them rotatably to the piston housing 7 and pump housing by valve seals 11 such as O-rings, both the rotation of the piston housings and the sealing of the inside of the piston housings 7 and the inlet and outlet valves 8, 9 are provided, and additional bearings are avoided.

Figure 2:
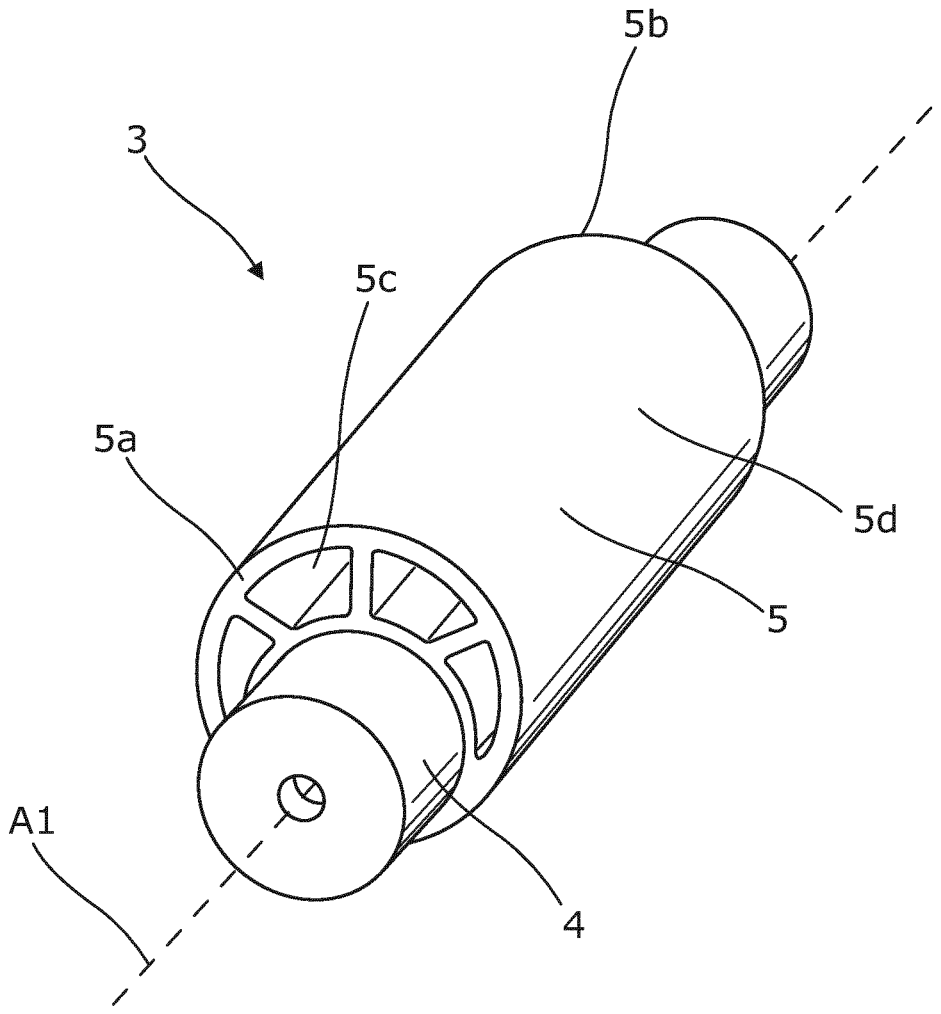
FIG. 2 shows a perspective view of a cam shaft.

FIG. 2 shows a perspective view of a cam shaft 3 where the cam lobe 5 extends in the longitudinal direction between a first and a second cam end face 5*a*, 5*b* and comprises one or more cavities 5*c* providing channels through the cam from the first cam end face 5*a* to the second cam end face 5*b*. This allows fluid to flow through the cavity/cavities 5*c* from one side of the cam to the other. Since the fluid from the operational tool to which the pump supplies fluid is often led back through the downhole hydraulic pump, i.e. a backflow of hydraulic fluid in the pump, to the inlet valves through an interior of the pump, the backflow may be maximised by having such channels. Furthermore, the cavities 5*c* have an additional advantage, namely that they are able to lower the mass of the cam lobe 5. By lowering the mass of the cam, the energy required to rotate the mass of the cam is minimised, which may be advantageous, especially during acceleration and deceleration. Furthermore, the imbalance effects from the rotating cam shaft are further minimised. The cam shaft 3 is rotated around the longitudinal spin axis A1 by means of a motor, and the motor is thus used more efficiently for pressurising the hydraulic fluid.

Figure 3:
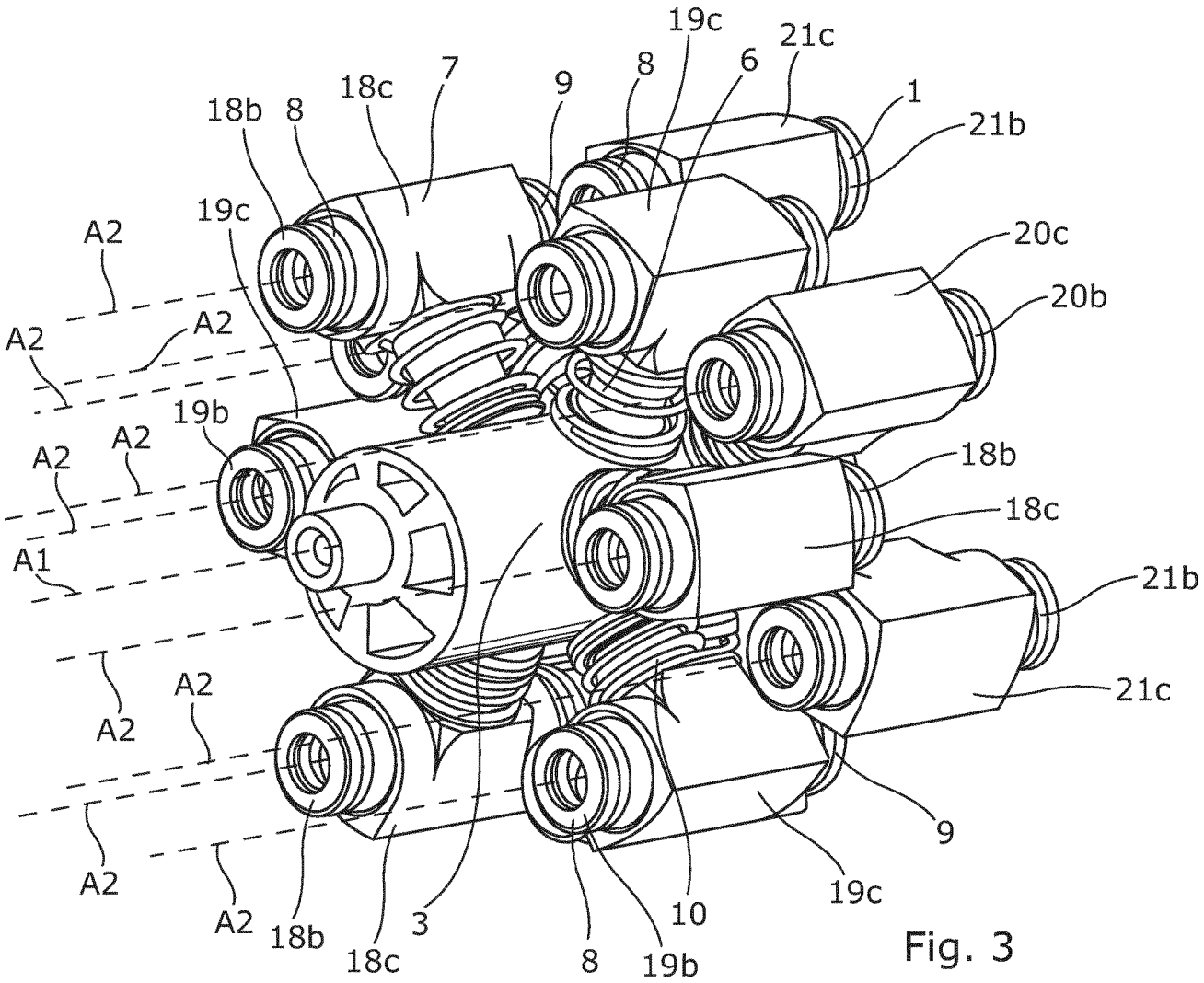
FIG. 3 shows a perspective view of a twelve piston configuration of a downhole hydraulic pump without a pump housing.

FIG. 3 shows a perspective view of a twelve piston configuration of a downhole hydraulic pump where the pump housing has been left out to be able to see a configuration of the pistons 6, piston housings 7, inlet/outlet valves 8, 9 and piston springs 10 between the cam shaft 3 and the piston housings. The configuration shown in FIG. 3 comprises twelve pistons 6 and twelve piston housings 7. During use, the cam shaft 3 rotates around the longitudinal spin axis A1 due to an external rotational force applied to the shaft 4, typically by an electrical motor, not shown, powered by electricity from the surface, not shown, or from a battery, not shown. The rotational force of the shaft is transferred to the pistons by the cam lobe 5, resulting in a reciprocating motion of the pistons 6 guided by the piston housings 7. FIG. 3 shows a plurality of piston springs 10 ensuring that the plurality of pistons is forced towards the cam of the cam shaft 3 at all times. In order for the hydraulic pump to function as intended, the pistons need to be pushed back towards the cam shaft since a negative pressure may exist in the interior of the piston housing due to the decrease of the volume. Furthermore, the hydraulic pump 1 may operate at very high rotational speeds, which makes it critical to the efficiency of the pump that the pistons 6 continue to keep in contact with the cam lobe 5 to ensure that the full pumping volume is obtained. At elevated revolution rates, the piston springs therefore need to have a high spring constant to keep up with the fast rotation. As shown in FIG. 3, the piston housings 7 have a first and a second end, and the inlet and outlet valves are arranged so that they cause a fluid flow in the first ends of the piston housings while a piston moves in the second ends of the piston housings. Thus, the openings 41 of the piston housing for letting fluid in and out of the housing are arranged close to the bottom of the piston housing 40, the piston housing being open so that the piston moves in and out of the piston housing towards and away from the bottom 40 of the housing.

The piston may alternatively be constituted by a more conventional piston and rod arrangement known from the art, which may lower a mass of the piston and may lower the resistance of the piston during movement in the piston housing.

Figure 4:
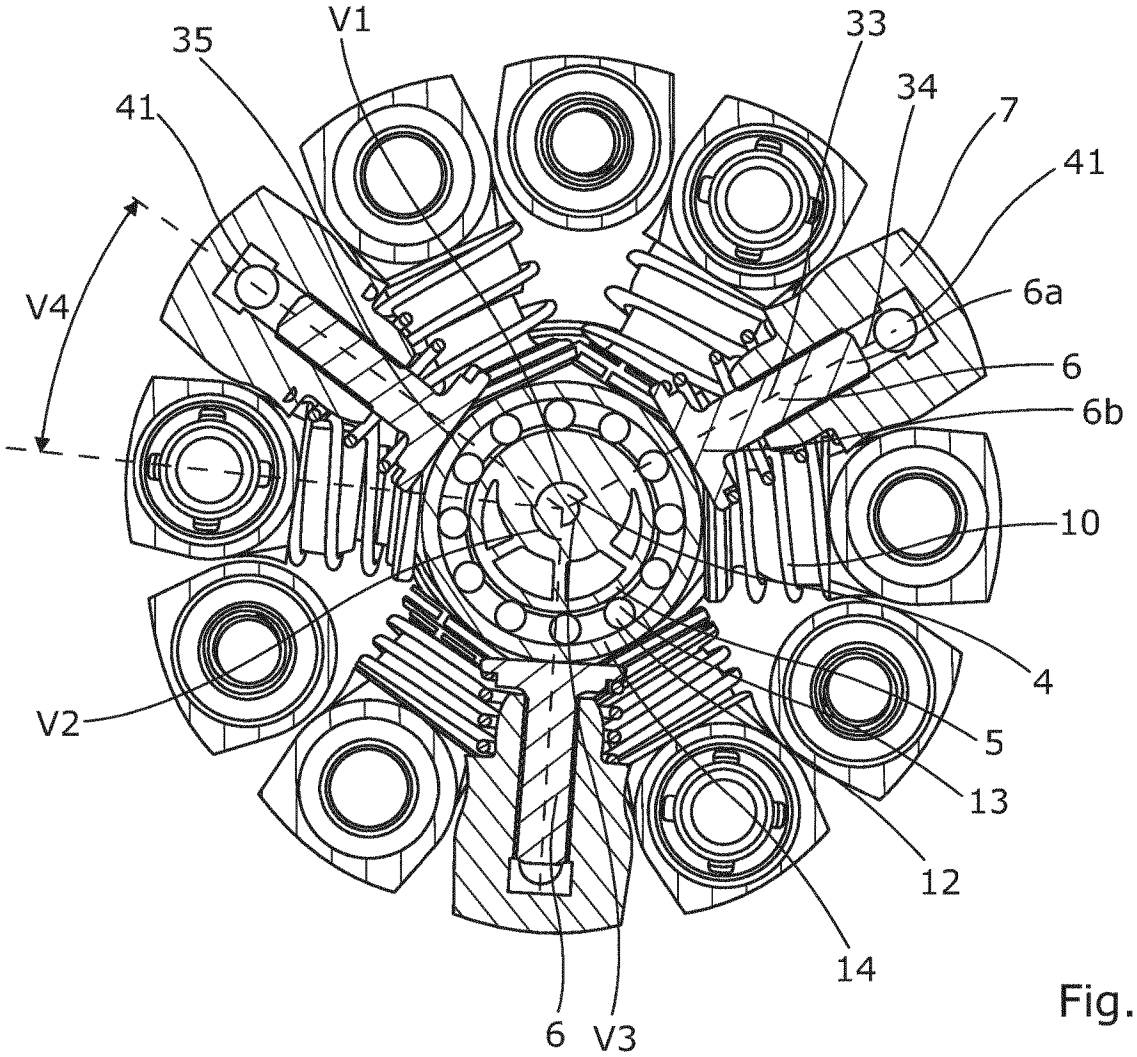
FIG. 4 shows a cross-sectional view of a twelve piston configuration of a downhole hydraulic pump without a pump housing.

FIG. 4 shows a cross-sectional view of a twelve piston configuration of a hydraulic pump 1. The cross-sectional view perpendicular to the longitudinal direction shown in FIG. 4 demonstrates how a plurality of sets of pistons may be arranged around the cam shaft 3. In this configuration, each set of pistons consists of three pistons arranged in a mutual piston angle (v1, v2, v3) of 120 degrees. In this configuration, four sets of three pistons have been arranged in a mutual piston set angle (v4) of 30 degrees. By shifting each set of pistons 30 degrees, the piston housings are allowed to overlap in the longitudinal direction, thus rendering it possible to decrease the overall extension of the pump in the longitudinal direction. In order to decrease the frictional forces between cam and pistons, a bearing, such as a needle bearing 14, is arranged around the cam lobe 5. To be able to arrange a needle bearing 14 around the cam, the cam lobe 5 may be an eccentric cylinder. In this way, the cam may freely rotate within the bearing, minimising transverse frictional forces between an outer surface of the cam 5*d* and the cam end of the pistons 6.

Figure 5:
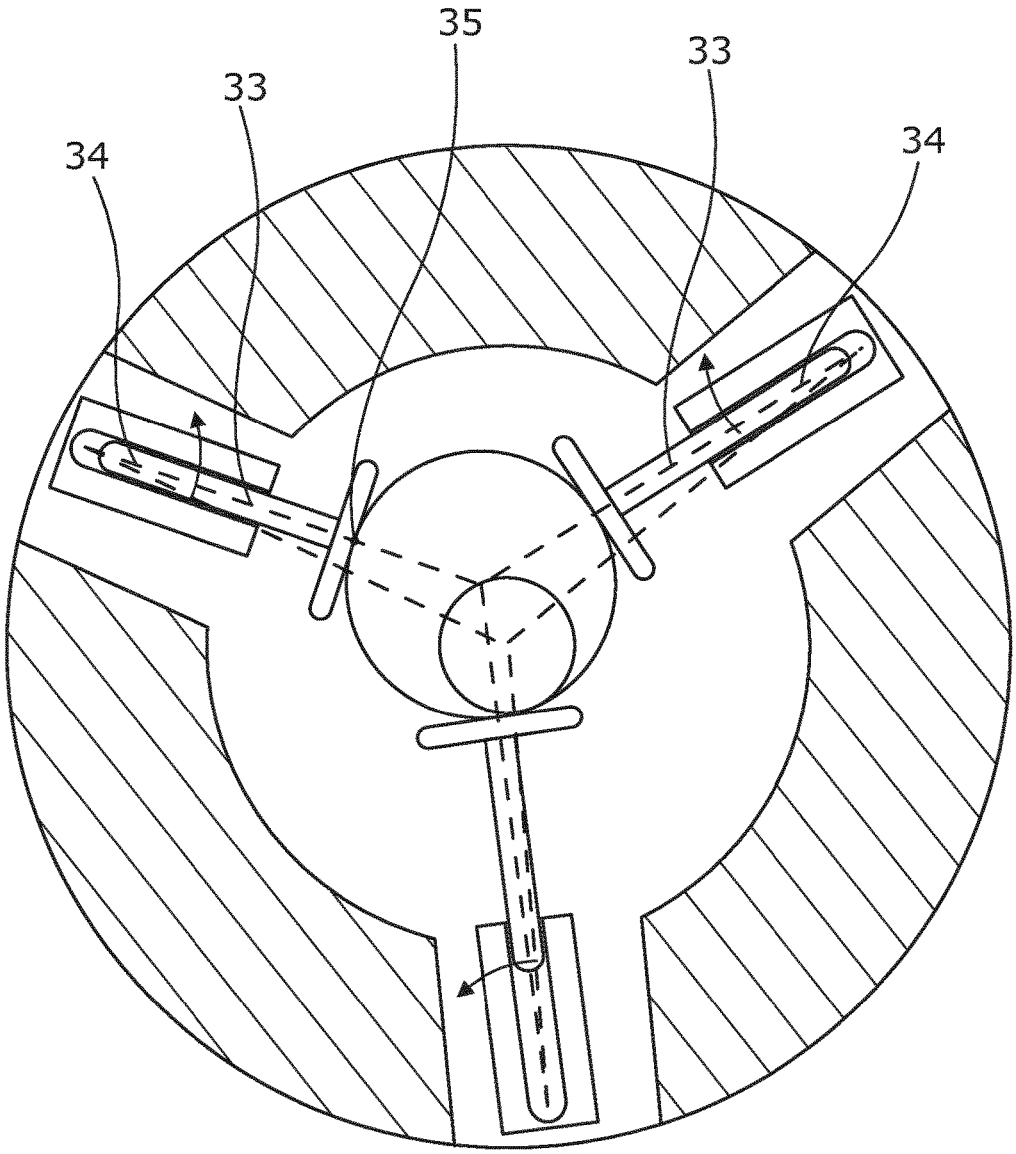
FIG. 5 shows a cross-sectional illustration of a pump housing.

FIG. 5 shows a schematic drawing of the pistons and cam shafts of one set of three pistons. Since the cam is positioned eccentrically relative to the longitudinal spin axis of the cam shaft, the pistons seek to engage the cam in a direction close to the center of rotation of the cam rather than the center of the shaft. Thus, the point of application 35 in which the force of the cam is transferred to the piston is always closer to the centre axis 33 of the piston so that the piston is not forced to move along a radial direction 34. In prior art pumps, the point of application is displaced from the centre axis 33 of the piston since the piston housing is not able to rotate towards a more optimal position with a more optimal point of application. Therefore, the ability of the piston housing to rotate around a piston housing rotation axis A2 allows the piston to engage the cam in a more optimal position, as shown in FIG. 5, which in turn increases the efficiency of the pump and reduces wear of the piston, the piston housing and the cam. When the cam shaft 3 is rotating, the pistons and piston housings will exert a "rocking" motion back and forth between two extreme positions.

Figure 6:
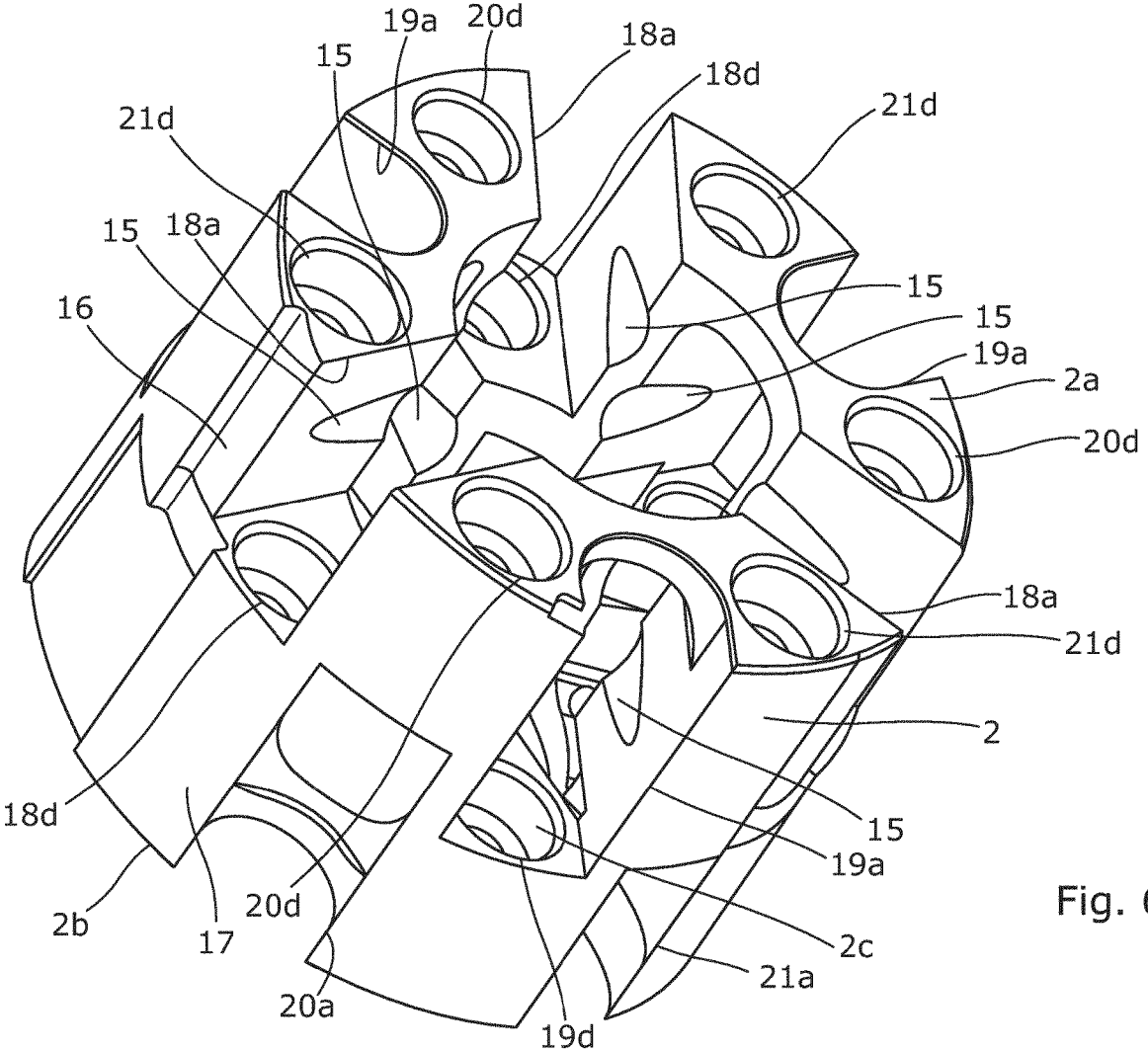
FIG. 6 shows the pump housing in perspective.

FIG. 6 shows a pump housing with a plurality of grooves, indents and carvings, explained below, all adapted to accommodate the moving parts shown in FIGS. 1-4, being the piston housing, the spring, the cam shaft and the piston. The pump housing 2 shown in FIG. 6 accommodates twelve pistons 6 in four sets of three pistons, as described above. The four sets of piston housings are accommodated in four sets of grooves (18*a*, 19*a*, 20*a*, 21*a*) having a mutual distance in the longitudinal direction of the pump housing 2. A first set of grooves 18*a* accommodates a first set of piston housings 18*c*, the piston housings 18*c* being attached to the pump housing 2 by means of the inlet and outlet valves 18*b* in a set of cylindrical grooves 18*d* in the pump housing 2, and mutadis mutandis for the three remaining sets of grooves (19*a*, 20*a*, 21*a*), inlet and outlet valves (19*b*, 20*b*, 21*b*), piston housings (19*c*, 20*c*, 21*c*) and cylindrical grooves (19*d*, 20*d*, 21*d*).

The pump housing has two pump housing end faces and at least one hollow section providing a fluid communication channel between the pump housing end faces. The pump housing may include a plurality of indentations, the indentations having a form corresponding to a neighboring movable part comprised within the pump housing, such as the piston, the piston housing, and/or the piston spring. The pump housing may further comprise a plurality of grooves along an outer surface of the pump housing.

The hydraulic pump 1 pumps the hydraulic fluid towards other downhole tools requiring hydraulic power during downhole operations. Typically, the hydraulic fluid is led back to the hydraulic pump 1 in a closed loop since operational time would otherwise be very limited since normally only small volumes of hydraulic oil are available in a downhole tool string. In such a closed loop of the hydraulic fluid, the hydraulic fluid is advantageously led back through an interior 37 of the pump due to the special limitations downhole. In this way, the interior 37 of the pump acts as a hydraulic fluid tank. Having this type of arrangement, however, requires that the flow through the interior 37 is not limited so that the pump is limited by the hydraulic flow back to the inlet valves 8. Therefore, the interior 37 has to be optimised for flow conditions through the pump housing. An additional advantage of such an arrangement is the constant lubrication of the moving parts inside the interior 37 by the hydraulic fluid.

The function of the piston spring 10 is to oppose the force from the cam trying to push the piston towards the piston housing. The piston springs 10 may, for convenience, be arranged alternatively to the embodiments shown in the figures, such as inside the piston or inside the piston housing and still fulfill the purpose of the spring.

The inlet and outlet valves 8, 9 may be one-way ball valves. To improve the responsiveness of the ball valves, very light balls 8*a* may preferably be used. Especially during very high rotational speeds, the weight of the balls might become a limiting factor to the efficiency of the pump since the balls cannot be moved quickly enough within the ball valve. For the purpose of having a very light ball, ceramic materials are very useful due to the combination of weight and durability. Since ceramic materials are very durable and very light, such materials may advantageously be used for the ball valves.

The cam shaft 3 is connected to a rotational shaft 42 of a motor and suspended in a set of cam shaft bearings 39, such as ball bearings, to ensure a smooth rotation of the cam shaft 3 with little friction.

The cam shaft bearings 39 may be locked with locking rings (not shown), again to provide more open space in the interior 37 to minimise the resistance of the backflow of hydraulic fluid through the pump housing.

The compactness of the hydraulic pump 1 with overlapping sets of piston housings allows for a very short pump shaft in the longitudinal direction. A short pump shaft, i.e. a short length of the cam and cam shaft, provides the ability to have a thin and strong shaft, since again, the dimension is essential for the versatility in downhole equipment. Furthermore, the symmetry of the pump provides a constant force on the cam shaft.

Figure 7:
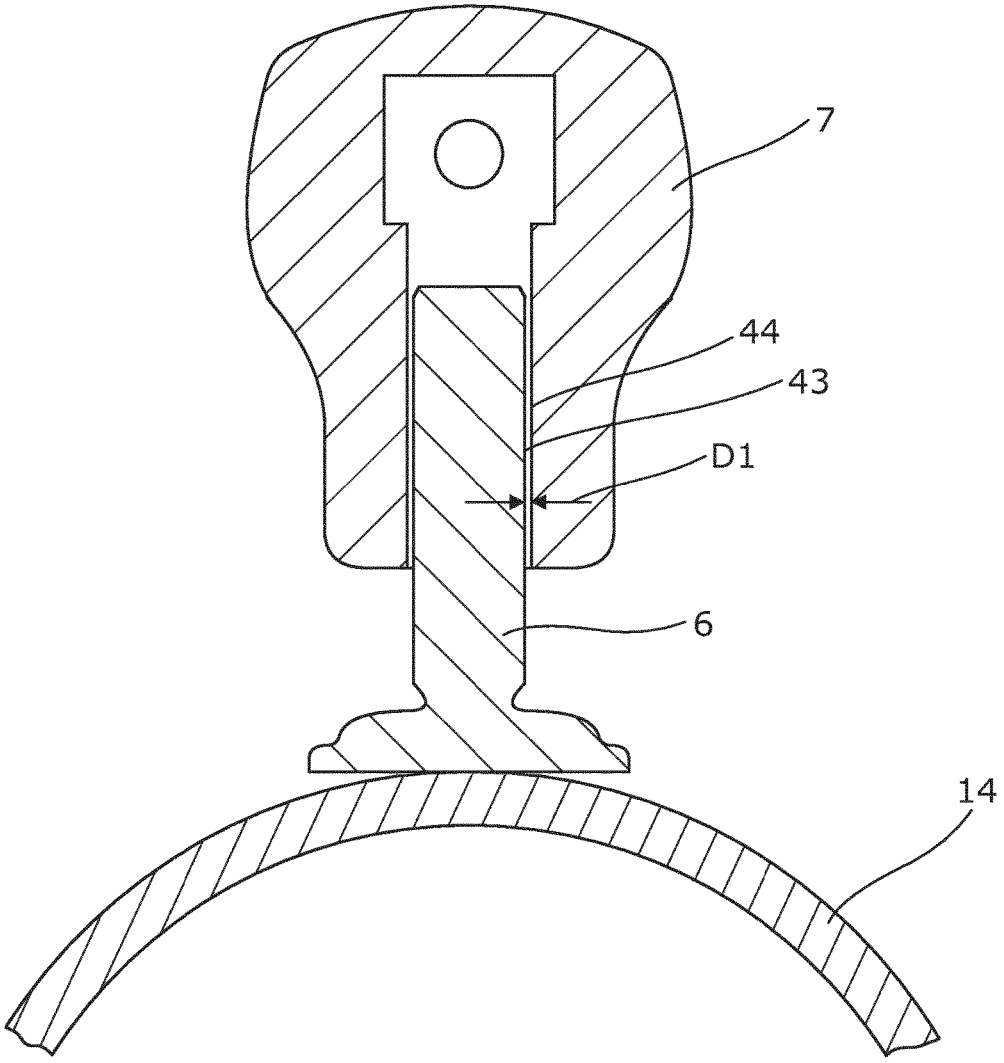
FIG. 7 shows a cross-sectional view of a piston and a piston housing.

FIG. 7 shows a cross-sectional view of a piston and a piston housing. The pistons and piston housings may preferably be made with a very small clearance distance D1 between an outer surface of the piston 43 and an inner surface of the piston housing 44. The clearance distance may also be termed "a diametrical clearance distance" (D1) since refers to the difference between the inner diameter of the piston housing and the outer diameter of the piston. Preferably, the clearance distance D1 may be smaller than ten micrometers, which may be achieved by manufacturing techniques such as honing. Having a clearance distance D1 this small will keep the leak through the gap acceptable and avoid further sealing of the piston housing to prevent oil from escaping the inside of the piston housing through the clearance distance D1.

Figure 8:
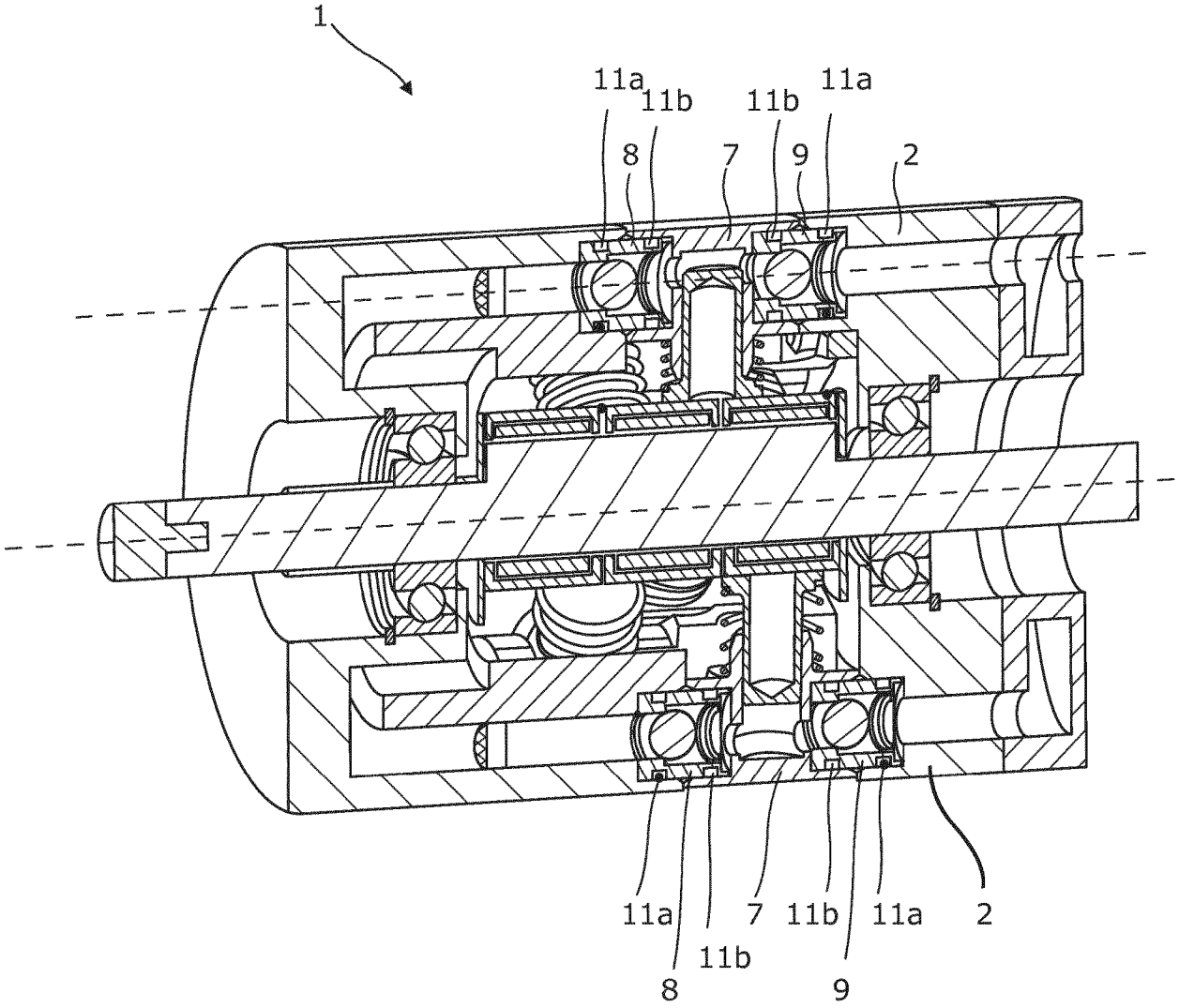
FIG. 8 shows a cross-sectional view of another embodiment of the downhole hydraulic pump.

FIG. 8 shows an embodiment of the hydraulic pump 1. The piston housings are arranged rotatably connected to the pump housing, as also shown in FIG. 1, by means of the inlet and outlet valves 8, 9 acting as hinges between the pump housing 2 and the piston housings 7. The movable attachment of the inlet and outlet valves 8, 9 to the piston housing 7 is facilitated by a ring-shaped valve seal 11*a*, 11*b*, such as provided by an O-ring, which in addition seals an interior of the inlet and outlet valves from an exterior. A given inlet valve 8 or outlet valve 9 may be fixedly connected to either the pump housing 2 or the piston housing 7 by a fixed ring-shaped valve seal 11*a* and be rotatably connected to the other of the pump housing 2 or the piston housing 7 by a non-fixed ring-shaped valve seal 11*b*. By using a valve having both a fixed and a non-fixed ring-shaped valve seal 11*a*, lib for fixation of the piston housing 7 to the pump housing 2, the wear on the fixed ring-shaped valve seal 11*a* may be minimised while still maintaining the ability of the piston housing 7 to rotate around the piston housing rotation axis. The non-fixed ring-shaped valve seal 11*a* may comprise a steel washer combined with an O-ring to ensure low friction between the valve 8, 9 and the piston housing 7. The use of a steel washer improves movability of the piston housing 7, however, the contact between the steel washer and piston housing increases wear on the piston housing. Therefore, in order to improve the lifespan of the pump to counter the increased wear on the piston housing, the piston housing may be hardened after production. If the valve 8, 9 is non-fixedly connected in both ends by a non-fixed ring-shaped valve seal 11*a*, increased wear on the pump housing 2 also occurs. Increased wear on the pump housing is a more severe problem since hardening of the entire pump housing is a much more expensive and difficult task. Hardening represents not only a hardening of the material but also a minor change in the dimensions of the material. This minor change in dimensions has to be accounted for in the dimensioning of the pump housing before hardening so that the pump housing has the right dimensions after hardening. As seen in e.g. FIG. 6, the pump housing 2 is a complicated structure, and controlled hardening is therefore difficult and expensive. Hardening of the piston housings 7 is less complicated, simply because the piston housings 7 are smaller and less complex than the pump housing 2. By fixing the inlet and outlet valves 8, 9 with a non-fixed ring-shaped valve seal 11*a* towards the piston housing 7 and a fixed ring-shaped valve seal 11*b* towards the pump housing 2, the problems mentioned above may be overcome. Alternatively, the inlet and/or outlet valves 8, 9 may be an integral part of the pump housing 2 and still be provided with only one non-fixed ring-shaped valve seal 11*a* to provide a rotatable piston fixture.

Thus, in order to decrease the wear of moving parts in the downhole hydraulic pump, the inlet and outlet valves may be fixedly connected with either the pump housing or the piston housings, but not necessarily both. By only non-fixedly connecting the inlet and outlet valves with the pump housing or the piston housings in one end of the inlet and outlet valves, the piston housing may still be rotated around an axis, and the wear of the pump may be decreased in the fixed end of the inlet and outlet valves.

The inlet and outlet valves may be fixedly connected to the pump housing or the piston housings by application of e.g. a fixed ring-shaped valve seal or a welded connection. In some embodiments of the invention, the inlet and outlet valves may be an integral part of the pump housing or piston housing.

Although the invention has been described in the above in connection with preferred embodiments of the invention, it will be evident for a person skilled in the art that several modifications are conceivable without departing from the invention as defined by the following claims.

The invention claimed is:

1. A downhole hydraulic pump for providing fluid power during downhole operations, comprising:

a pump housing configured to be placed downhole in a borehole, a cam shaft rotatably arranged in the pump housing and having a longitudinal spin axis, the cam shaft comprising a shaft and a cam lobe arranged on the shaft, a radially arranged piston having a housing end and a cam end, a piston housing arranged in the pump housing, an inlet valve arranged in an inlet in the piston housing, an outlet valve arranged in an outlet in the piston housing, and a piston spring arranged in the pump housing for moving the piston away from the piston housing, a channel formed in a pump body in the pump housing and including a longitudinal channel axis disposed parallel to the longitudinal spin axis, wherein the piston housing is rotatably connected to the pump housing, enabling rotation of the piston housing around a piston housing rotation axis parallel to but offset from the longitudinal spin axis of the cam shaft, wherein the piston is configured to pump fluid into the channel and along the longitudinal channel axis.

2. A downhole hydraulic pump according to claim 1, wherein a clearance distance between a piston side wall and an inner wall of the piston housing is below ten micrometers in width.

3. A downhole hydraulic pump according to claim 1, furthermore comprising a bearing arranged between the cam shaft and the cam end of the piston.

4. A downhole hydraulic pump according to claim 1, comprising a set of pistons, piston housings, inlet valves, outlet valves and piston springs arranged in the pump housing and having a mutual distance along the longitudinal spin axis.

5. A downhole hydraulic pump according to claim 1, comprising a plurality of pistons, a plurality of piston housings, a plurality of inlet valves, a plurality of outlet valves and a plurality of piston springs, wherein a set comprises one piston, one piston housing, one inlet valve, one outlet valve and one piston spring, the downhole hydraulic pump comprising a plurality of sets arranged in the pump housing and having a mutual distance along the longitudinal spin axis, each set being arranged symmetrically in an asterisk shape, substantially radially away from the longitudinal spin axis.

6. A downhole hydraulic pump according to claim 1, wherein the inlet and outlet valves are one-way valves.

7. A downhole hydraulic pump according to claim 1, further comprising an accumulating unit in fluid connection with the plurality of outlet valves.

8. A downhole hydraulic pump according to claim 1, wherein the cam lobe having two cam lobe end faces further comprises at least one hollow section providing a fluid communication channel between said cam lobe end faces.

9. A downhole hydraulic pump according to claim 1, wherein the pump housing having two pump housing end faces further comprises at least one hollow section providing a fluid communication channel between said pump housing end faces.

10. A downhole hydraulic pump according to claim 1, further comprising a plurality of indentations in the pump housing, the indentations having a form corresponding to a neighbouring movable part comprised within the pump housing.

11. A downhole hydraulic pump according to claim 1, wherein the piston housing is rotatably suspended in the pump housing.

12. A downhole hydraulic pump according to claim 1, wherein the piston housing is rotatably attached to the pump housing in a first end of the piston housing by arranging the inlet valve in a cylindrical groove in the pump housing, suspended by a rotatable ring-shaped seal in one end, and attaching an opposite end of the inlet valve in the piston housing and in a second end of the piston housing by arranging the outlet valve in a cylindrical groove in the pump housing and suspended by a rotatable ring-shaped seal in one end and attaching an opposite end of the outlet valve in the piston housing.

13. A downhole hydraulic pump according to claim 1, wherein the piston spring has a spring constant exceeding 2000 N/m.

14. A downhole hydraulic pump according to claim 1, further comprising a plurality of grooves along an outer surface of the pump housing.

15. A downhole hydraulic pump according to claim 1, wherein the inlet and outlet valves are fixedly connected with the pump housing or the piston housing.

16. A downhole hydraulic pump according to claim 15, wherein the inlet and outlet valves are fixedly connected with the pump housing or the piston housing by a fixed ring-shaped valve seal.

17. A downhole hydraulic pump according to claim 15, wherein the inlet and/or outlet valves are integral parts of the pump housing or the piston housing.

18. A downhole hydraulic pump according to claim 1, wherein the inlet and outlet valves are non-fixedly connected with the pump housing or the piston housings.

19. A downhole hydraulic pump according to claim 18, wherein the inlet and outlet valves are non-fixedly connected with the pump housing or the piston housing by non-fixed ring-shaped valve seals.

20. A downhole hydraulic pump according to claim 1, wherein the inlet and outlet valves are fixedly connected with the pump housing, and the inlet and outlet valves are non-fixedly connected with the piston housing.

21. A downhole hydraulic pump according to claim 1, wherein the pump housing is cylindrical in shape.

22. A downhole hydraulic pump according to claim 1, wherein a rotational force of the shaft is transferred to the piston by the cam lobe to move the piston into the piston housing.

23. A downhole hydraulic pump according to claim 1, wherein the inlet and the outlet are aligned and disposed along an axis parallel to the longitudinal spin axis such that, in use, hydraulic fluid flows through both the inlet and the outlet in a direction parallel to the longitudinal spin axis.

24. A downhole hydraulic pump according to claim 1, wherein the pump housing comprises a housing outlet with an axis parallel to the longitudinal spin axis.

* * * * *